United States Patent [19]

Randall

[11] 4,132,266

[45] Jan. 2, 1979

[54] PIPE SHEARING RAM ASSEMBLY FOR BLOWOUT PREVENTER

[75] Inventor: Ross D. Randall, Houston, Tex.

[73] Assignee: Cameron Iron Works, Inc., Houston, Tex.

[21] Appl. No.: 893,977

[22] Filed: Apr. 6, 1978

[51] Int. Cl.[2] ..... E21B 29/00

[52] U.S. Cl. ..... 166/55; 251/1 A; 137/242

[58] Field of Search ..... 166/55, 55.1, 55.2, 166/55.3; 251/1 A, 1 R; 30/92; 137/242

[56] References Cited

U.S. PATENT DOCUMENTS

| | | | |
|---|---|---|---|
| 2,919,111 | 12/1959 | Nicolson | 166/55 X |
| 2,969,838 | 1/1961 | Wilde | 166/55 |
| 3,379,255 | 4/1968 | Burns, Jr. et al. | 166/55 |
| 3,561,526 | 2/1971 | Williams, Jr. | 166/55 |
| 3,736,982 | 6/1973 | Vujasinovic | 251/1 A X |
| 3,817,326 | 6/1974 | Meynier | 166/55 |
| 3,841,347 | 10/1974 | Kushida | 137/242 |
| 3,872,878 | 3/1975 | Kozel | 137/242 |

*Primary Examiner*—Ernest R. Purser
*Assistant Examiner*—Richard E. Favreau
*Attorney, Agent, or Firm*—Vinson & Elkins

[57] ABSTRACT

A shear ram assembly for a blowout preventer having a pair of rams with opposed shear blades, means for moving the shear blades across the pipe opening of the blowout preventer, one of the rams having a shoulder spaced from the shearing plane of the blades, a face seal mounted in a recess in the ram having the shoulder and positioned so that the blade on the other ram bends the cut pipe around the shoulder and then seals against said face seal, and means for preventing metal parts from collecting in front of said face seal.

9 Claims, 5 Drawing Figures

46
32
24
42
47
26
34
48
36
38
40
50

46a
32a
24a
42a
40a
34a
36a
52a
44a
38a
26a
18a
14a

PIPE SHEARING RAM ASSEMBLY FOR BLOWOUT PREVENTER

BACKGROUND OF THE INVENTION

Prior art blowout preventer shear rams include a type in which a seal is provided for the face or faces of the shear blades to seal sgainst (U.S. Pat. No. 3,651,526 to L. E. Williams, Jr. et al.) and another type in which the seal for the blades is contained in a recess in one of the blades to seal against the other shear blade along the shear plane (U.S. Pat. No. 3,817,326 to M. J. Meynier III and U.S. Pat. No. 3,736,982 to A. N. Vujasinavic). For each time these rams are operated to shear, they are operated great number of times to act as blind rams. The service life of such shear rams is limited by excessive ram packing forces which result from limited packing area and the excessively wide crack between confronting blade surfaces which is bridged by packing. Also with the prior art pipe shear rams for blowout preventers little attention is given to assure that the debris from the sheared pipe does not interfere with the sealing.

SUMMARY

The present invention relates to an improved shear ram assembly for a blowout preventer.

The improved shear ram assembly includes a pair of shear rams, each of said rams having a shear blade, one of the shear rams having a shoulder spaced from the shearing plane and a face seal supported in the shear ram having said shoulder, said face seal being recessed a sufficient distance from the shoulder so that pipe between the forward face of the shear blade of the other ram and said face seal is bent on such shoulder and out of the path of said shear blade of the other ram toward sealing engagement with said face seal. Also a groove is provided for the collection of debris below the shear plane so that it does not interfere with the seals.

This structure minimizes wear on the seal and avoids having to seal around pipe ends and metal debris.

BRIEF DESCRIPTION OF THE DRAWINGS

These and other advantages of the improved structure of the present invention are hereinafter set forth and explained with reference to the drawings wherein.

DESCRIPTION OF THE PREFERRED EMBODIMENT

Figure 1:
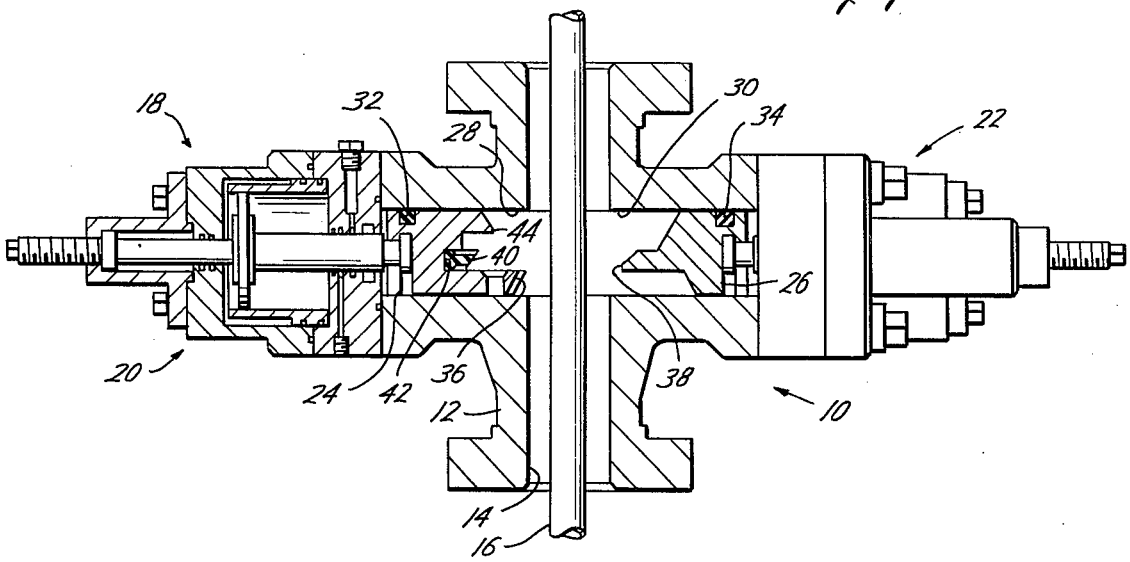
FIG. 1 is a side view partially in section of a blowout preventer having the improved ram assembly of the present invention in retracted position.

The blowout preventor 10 shown in FIG. 1 is generally of the usual design including the body 12 having the pipe bore 14 through which pipes such as 16 are adapted to extend, the improved shear ram assembly 18 of the present invention and the pressure responsive means 20 and 22 for moving the rams 24 and 26 toward each other into sealed position closing pipe bore 14 and for retracting the rams 24 and 26 from such position.

Figure 2:
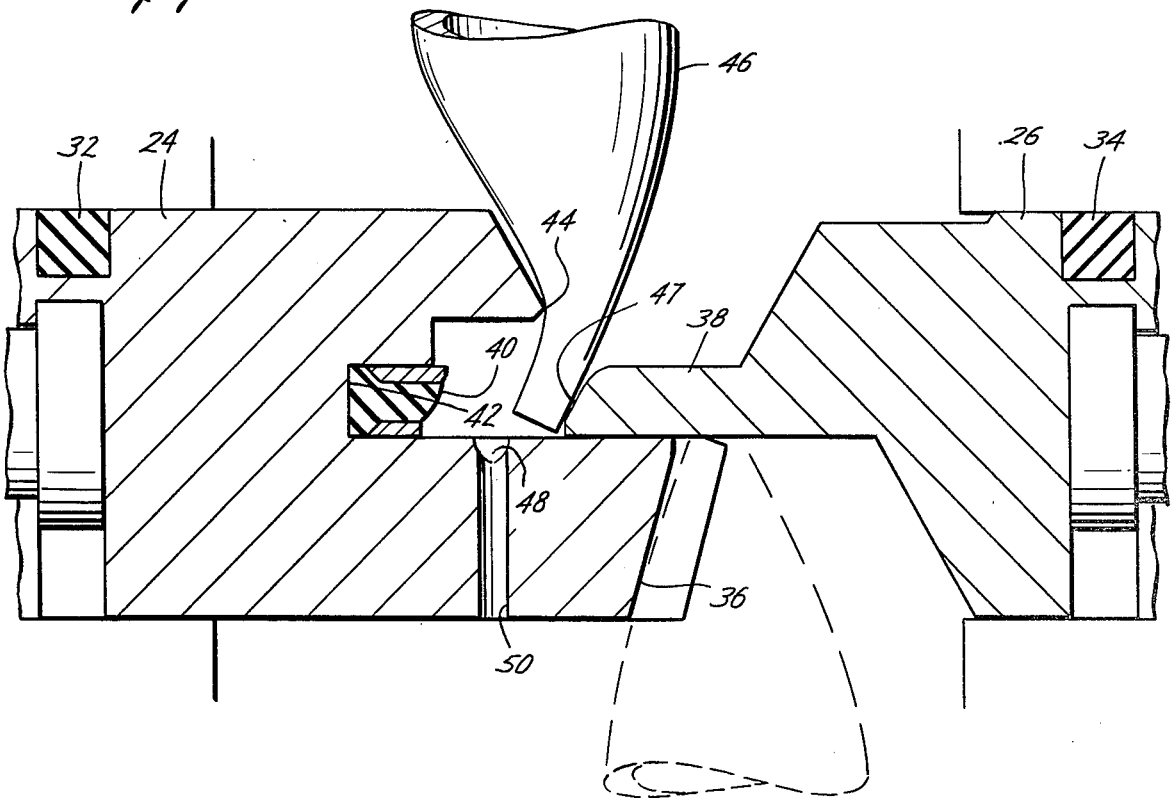
FIG. 2 is a detail sectional view of the rams immediately following the shearing of the pipe.
Figure 5:
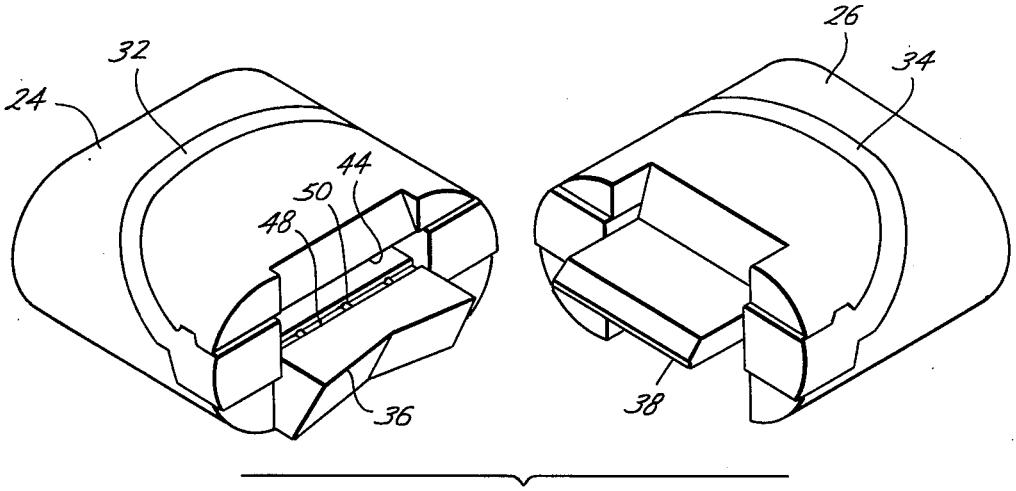
FIG. 5 is an isometric view of the ram assembly.

The rams 24 and 26 are slidable in the guideways 28 and 30 within body 12 and are provided with suitable sealing means 32 and 34. The ram 24 has shear blade 36 projecting toward ram 26 which has the projecting shear blade 38. Both shear blades 36 and 38 are of the well known design with the central portion of at least one blade recessed and the side portions extending toward the other ram to provide some centering of the pipe 16 as the rams close thereon. This blade contour is shown in FIG. 5 and is similar to the blade contour disclosed in the aforementioned Meynier U.S. Pat. No. 3,817,326. Blade 36 coacts with blade 38 to shear pipe 16, as shown in FIG. 2 along the shearing plane which is established along the upper surface of blade 36 and along the lower surface of blade 38. The shearing plane may actually allow a small gap between the upper and lower blades to avoid interference thereof.

Figure 3:
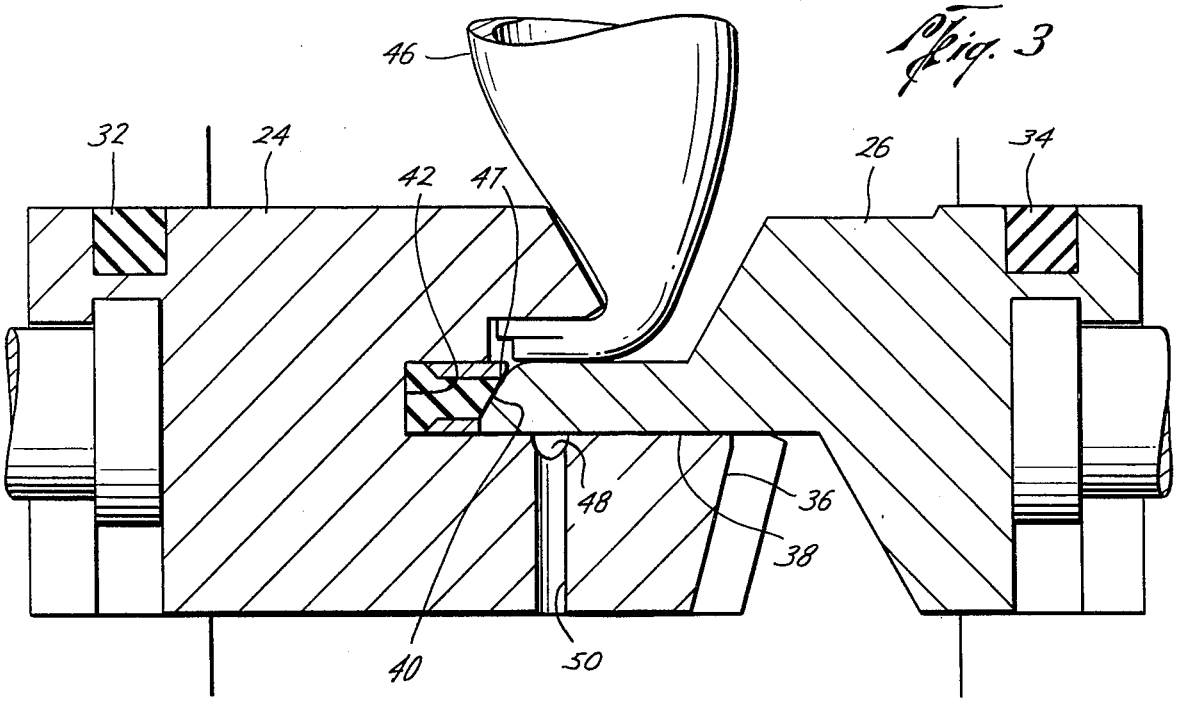
FIG. 3 is a detail sectional view of the rams in sealed position following the shearing of the pipe and showing the end of the upper section of sheared pipe bent on the shear ram shoulder so that it does not interfere with sealing of the face of the upper ram.

Ram 24 includes the face seal 40 positioned within the recess 42 and the shoulder 44 which projects inward beyond face seal 40. Shoulder 44 is spaced above the upper surface of blade 36 and inward from face seal 40 a sufficient distance so that the face of blade 38 engages the upper cut section 46 of pipe 16 and bends it on the shoulder 44 as the face 47 of blade 38 moves thereby and toward sealing engagement with seal 40. This face sealing position is shown in FIG. 3 and as can be seen, the pipe section 46 has been bent on shoulder 44 and out of the path of the forward face of blade 38 so that it does not interfere with the face seal between the rams.

In shearing pipe small pieces of metal may break loose from the pipe section 46 and collect on the upper surface of shear blade 36. Such debris if not properly handled could interfere with the blade face sealing. In one form of the present invention, the upper surface of blade 36 includes the groove 48. With such groove 48 these small pieces of metal fall therein and are out of the path of blade 38 toward seal 40. At least one drain hole 50 (preferably a plurality of drain holes) extends through blade 36 to drain debris collecting in groove 48 downward into the bore 14 to assure that excess debris does not fill and overflow groove 48 and thus interfere with the face sealing.

Figure 4:
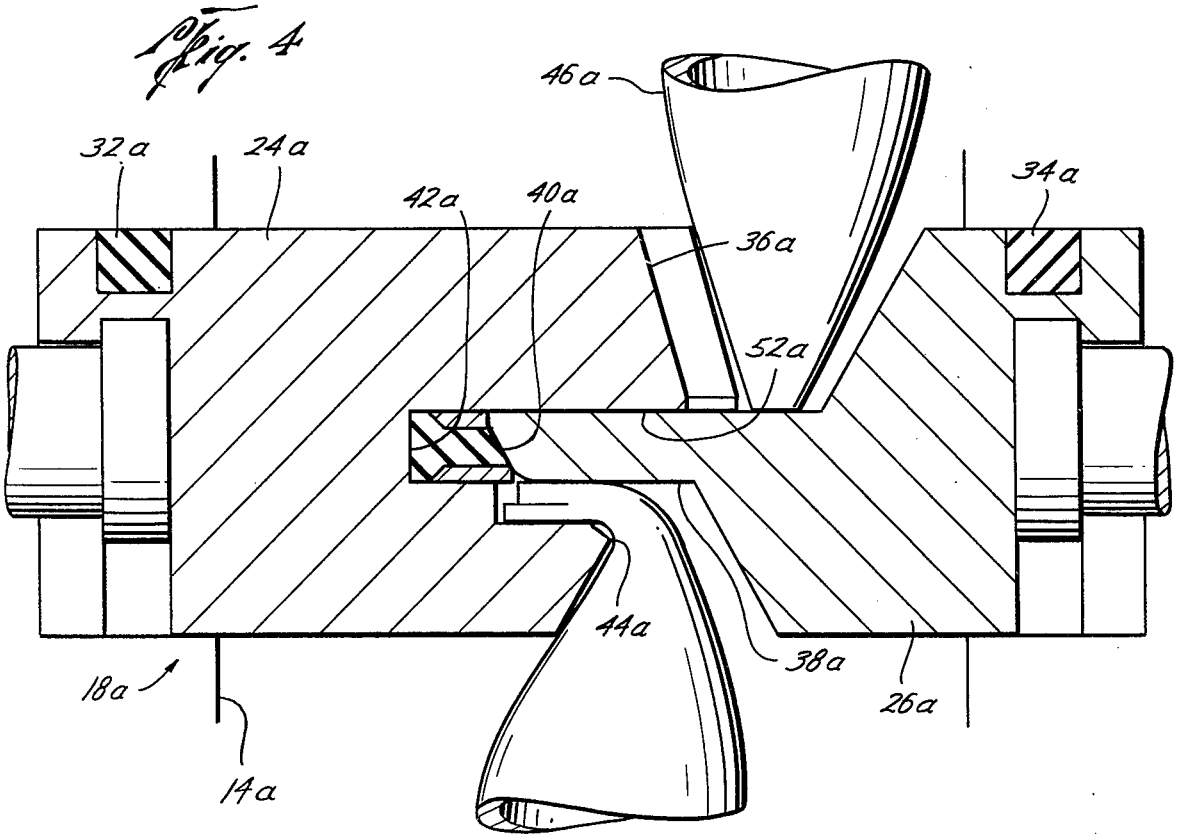
FIG. 4 is a similar sectional view to FIG. 3 showing a modified embodiment of the present invention.

In another form of the invention shown in FIG. 4, the problem of debris interferring with the face sealing of the rams is resolved by inverting the structure of the ram assembly 18. In FIG. 4, the parts of the illustrated structure are given the same number as those same parts have in the other drawings and the suffix "a" is added to indicate the inversion of the parts. Thus, ram assembly **18*a* includes a ram 24*a* having the shear blade 36*a*, the recess 42*a* below the shearing line and the shoulder 44*a* spaced a sufficient distance below shear blade 36*a* and inward of face seal 40*a* to assure that the cut pipe section 46*a* bends on shoulder 44*a* and out of the path of shear blade 38*a* on ram 26*a***.

Since the surface **52*a* in front of face seal 40*a* faces downward, the debris which results from the shearing of the pipe 16*a* falls through the bore 14*a* into the well bore below and does not accumulate on surface 52*a*** in a position to interfere with the face sealing.

The improved blowout preventer of the present invention thus provides improved ram assemblies with a face seal which avoids the problem of rams moving across seals and also eliminates the interference of the cut pipe section and debris with the face seal.

What is claimed is:

1. A blowout preventer, comprising a body having a pipe opening therethrough, ram guideways extending laterally from opposite sides of the pipe opening, a ram assembly including a pair of rams each positioned in one of said guideways and means for moving the rams together to close off the pipe openings and for moving the rams apart to open the pipe opening, seal means for said ram assembly, each of said rams having a pipe shearing blade extending inward, and one of said rams having a shoulder and a face seal being a portion of said seal means and adapted to be engaged by the face of the shear blade of the other of said rams, said shoulder being spaced inward from said face seal and being a sufficient distance from the shearing plane of said two blades whereby pipe cut by said blades is engaged by the face of the shear blade of the other of said rams and bent on said shoulder out of its path toward sealing engagement with said face seal.

2. A blowout preventer according to claim 1 wherein said face seal and said shoulder are above the shearing plane and the cut pipe is bent to move above said face seal.

3. A blowout preventer according to claim 1 including means for preventing collection of debris between the face of the other of said rams and said face seal.

4. A blowout preventer according to claim 3 wherein said means for preventing debris collection includes, a groove on the upper surface of the blade of said one ram.

5. A blowout preventer according to claim 4 including a least one drain hole through the blade of said one ram from said groove to drain debris through the blade into the pipe opening below said rams.

6. A blowout preventer comprising, a body having a pipe opening therethrough, ram guideways extending laterally from opposite sides of the pipe opening, a ram assembly comprising first and second rams, each located in one of the ram guideways, and means for moving the rams together to close off the pipe opening and for moving the rams apart to open the pipe opening, each ram having a shear blade in position for the cutting edge of a first blade on said first ram to pass just above the cutting edge of a second blade on the said second ram to shear a pipe positioned in the pipe opening when the rams are moved together to close off the opening, a seal positioned in said second ram at a location to be engaged by the forward face of said first blade, and an inwardly extending transverse shoulder on said second ram spaced above said seal and projecting inwardly beyond said seal whereby the end of a sheared pipe remaining in said pipe opening is engaged by and bent on said shoulder out of the path of said upper blade so that said upper blade may seal against said seal.

7. A blowout preventer according to claim 6, including a groove positioned in the upper surface of said lower shear blade immediately inward of said seal to receive pieces of pipe and other debris which would interfere with the sealing engagement of said forward face of said upper shear blade with said seal.

8. A ram assembly for a ram type blowout preventer, comprising first and second rams, when installed in a blowout preventer movable toward and away from each other, each of said rams having a pipe shearing blade, said blades being adapted to coact to shear a pipe along a shearing plane when said rams are moved together, one of said rams having a face seal and a shoulder on one side of the shearing plane of said blades, and said shoulder being spaced a sufficient distance inward and away from said shearing plane whereby the blade of the other ram engages a cut section of pipe, bends the cut section on said shoulder and moves into sealing engagement with said face seal.

9. A ram assembly according to claim 8 wherein said rams are arranged to avoid the collection of debris between said face seal and the forward sealing face on said other blade.

* * * * *